US008123231B2

(12) United States Patent
McComb

(10) Patent No.: US 8,123,231 B2
(45) Date of Patent: Feb. 28, 2012

(54) SEAL

(76) Inventor: Barry Philip McComb, Orpington (GB)

( * ) Notice: Subject to any disclaimer, the term of this patent is extended or adjusted under 35 U.S.C. 154(b) by 888 days.

(21) Appl. No.: 12/088,623

(22) PCT Filed: Sep. 28, 2006

(86) PCT No.: PCT/GB2006/003607

§ 371 (c)(1),
(2), (4) Date: Apr. 24, 2008

(87) PCT Pub. No.: WO2007/036726

PCT Pub. Date: Apr. 5, 2007

(65) Prior Publication Data

US 2008/0252022 A1 Oct. 16, 2008

(30) Foreign Application Priority Data

Sep. 28, 2005 (GB) ..... 0519681.1
Sep. 28, 2006 (GB) ..... 0619102.7

(51) Int. Cl.
*A47K 3/16* (2006.01)
*F16J 15/02* (2006.01)

(52) U.S. Cl. ..... 277/630; 277/637; 52/35

(58) Field of Classification Search ..... 277/637, 277/641, 644, 647, 648, 649, 650, 921, 630; 52/60, 62, 58, 35, 302.6, 61
See application file for complete search history.

(56) References Cited

U.S. PATENT DOCUMENTS 2,303,864 A * 12/1942 Reasor ..... 52/716.2
6,419,238 B2 * 7/2002 McComb ..... 277/630
7,040,060 B2 * 5/2006 Cox ..... 52/169.7
2001/0054799 A1 * 12/2001 McComb ..... 277/590
2002/0059764 A1 5/2002 Schlueter

FOREIGN PATENT DOCUMENTS

DE 8502740 U1 10/1985

(Continued)

OTHER PUBLICATIONS

International Search Report for related PCT Application PCT/GB2006/003607 mailed Feb. 6, 2007.

*Primary Examiner* — Gilbert Lee
(74) *Attorney, Agent, or Firm* — Heslin Rothenberg Farley & Mesiti P.C.

(57) ABSTRACT

A seal for sealing between two surfaces lying generally perpendicular to each other, the seal comprising a first profile which has a base adapted to be fixed sealingly to a first surface and an upstand which projects from the base and which defines respective inner and outer opposed surfaces, and a second profile which overlies the upstand of the first profile and which, when viewed in section, comprises inner and outer depending limbs which engage slidably respective ones of the opposed inner and outer surfaces of the upstand of the first profile, wherein at least one of the inner and outer depending limbs of the second profile bears resiliently against the respective surface(s) of the upstand of the first profile in sliding engagement therewith.

22 Claims, 7 Drawing Sheets

FOREIGN PATENT DOCUMENTS

| | | | |
|---|---|---|---|
| EP | 1199424 | A1 | 4/2002 |
| GB | 2289924 | A | 12/1995 |
| GB | 2320068 | A | 6/1998 |
| GB | 2322644 | A | 9/1998 |
| GB | 2411350 | A | 8/2005 |

* cited by examiner

SEAL

CROSS REFERENCE TO RELATED APPLICATIONS

This application is a §371 national stage filing of PCT International Application No. PCT/GB2006/003607 filed on Sep. 28, 2006 and published in English on Apr. 5, 2007 as PCT publication WO 2007/036726 A1, which claims the benefit of priority from British application number GB 0519681.1, filed on Sep. 28, 2005, and British application number GB 0619102.7, filed on Sep. 28, 2006. The entire disclosures of these applications are incorporated herein by reference.

This invention relates to a seal for providing a liquid-tight barrier between two surfaces lying generally perpendicular to each other. The invention is directed especially, but not exclusively, to a seal for application between a sanitaryware item, such as a bath, basin or shower tray, to prevent, or at least substantially reduce, seepage of water between the item and an adjacent wall or other upright surface against which the item is installed. The seal of the invention can also be used for sealing between a work surface or skirting and an adjacent wall or other upright surface.

In my British Patent No. 2289924, there is described and claimed a seal for sealing between two surfaces lying at substantial right angles to each other, with the seal comprising two preformed, liquid-impervious strips having respective interlocatable members. One of the strips is generally L-shaped with its interlocatable member being constituted by one limb thereof, with the other limb providing a first outer surface and sealing edge. The interlocatable member of the other strip comprises a surface which overlies the first limb of the one strip to form a second outer surface for the seal, with the first and second outer surfaces of the two strips being contiguous with each other.

Experience has shown that this known seal is both complex in structure and has been found to be difficult to install satisfactorily, particularly at corners.

U.S. Pat. No. 4,829,731 discloses a complex device for forming a transition between two perpendicularly-adjoining surfaces, the device having first and second angled legs, an elastic sealing strip moulded to and extending the first leg, a hard plastics fitting leg moulded to the strip and facing away from the second leg and an adhesive profile with a support bridge moulded to the fitting leg.

This known device allows for compensation of the different stresses occurring in the surfaces bounding the jointing.

In U.S. Pat. No. 4,204,376, there is described a finishing strip or moulding for engaging between a wall and an article, which has first and second rigid profiles and first and second flexible profiles joined to their respective rigid sections, with the rigid profiles folded upon each other and latched together by an ear and tab.

All the known types of seal and other devices discussed above are complex in nature and tend to be difficult to install, whilst the components thereof which perform the sealing function tend to lose their resilience over time or are insufficiently resilient in the first place, thereby having a deleterious effect on the integrity of the installed seals.

It is an object of the present invention to provide a seal which overcomes, or at least substantially reduces, the disadvantages associated with the known seals discussed above.

Accordingly, the invention resides in a seal for sealing between two surfaces lying generally perpendicular to each other, the seal comprising a first profile which has a base adapted to be fixed sealingly to a first surface and an upstand which projects from the base and which defines respective inner and outer opposed surfaces, and a second profile which overlies the upstand of the first profile and which, when viewed in section, comprises inner and outer depending limbs which engage slidably respective ones of the opposed inner and outer surfaces of the upstand of the first profile, wherein at least one of the inner and outer depending limbs of the second profile bears resiliently against the respective surface (s) of the upstand of the first profile in sliding engagement therewith.

Preferably, both the inner and outer depending limbs of the second profile bear resiliently against the respective surfaces of the upstand of the first profile in sliding engagement therewith.

Preferably also, it is the free end of the or each inner and outer depending limbs of the second profile which engages slidably the respective surface(s) of the upstand of the first profile.

In practice, and when the seal is installed, the first profile may represent a lower profile which can be secured to, say, the generally horizontal rim of a sanitaryware item or a worktop, whilst the second profile may represent an upper profile secured to, say, a wall or other generally vertical support surface to which the sanitaryware item or worktop is installed. In such an event, the upstand of the lower profile would project upwardly from the base thereof and the inner and outer limbs of the upper profile would extend downwardly.

In an embodiment of seal to be described in more detail hereinbelow, the two profiles are preformed and at least the inner depending limb of the second profile is inclined inwardly of the seal, such that, when the seal is installed, a space for adhesive is defined between that inner limb and the surface engaged by the second profile. On installation of the seal, the inner and outer depending limbs of the second profile may bend, due to inherent resilience and as they bear resiliently against respective inner and outer surfaces of the upstand of the first profile.

Preferably, the outer surface of the outer depending limb of the second profile and the outer surface of the upstand of the first profile which is engaged slidably by that outer limb, define at least part of the outer surface of the seal when installed.

The upstand of the first profile may comprise one or more upstanding ribs. If, for example, the upstand comprises one upstanding rib, then the opposed inner and outer surfaces thereof are engaged respectively by the inner and outer depending limbs of the second profile, preferably by the free ends of those limbs.

If, however, the upstand comprises two spaced upstanding ribs, preferably generally parallel with each other, then the inner surface of the inner rib is engaged by the inner depending limb of the second profile and the outer surface of the outer rib is engaged by the outer depending limb of the second profile.

The upper regions of the respective inner and outer depending limbs of the second profile may be connected integrally together by means of a cover portion whose juncture with the upper region of the inner limb is adapted to engage sealingly one of the two perpendicular surfaces to which the seal can be installed.

Preferably, the base of the first profile of the seal has an inner heal and an outer toe adapted to be adhered sealingly to the other of the two surfaces to which the seal is installed.

In another embodiment to be described in more detail below, the free end of the outer limb of the second profile is arranged to engage the outer surface of the upstand of the first profile at a different level, usually a lower level, than the free end of the inner limb of the second profile engages the inner surface of the upstand. In this arrangement, such different levels of engagement of the free ends of the outer and inner limbs of the second profile with the respective outer and inner surfaces of the upstand tends to apply a moment to at least the second profile which urges it toward the surface to which it is secured when the seal in installed and during installation.

The inner surface of the upstand may be provided with a stop which is engaged by the free end of the inner limb of the second profile when the seal is in its fully contracted condition.

Preferably, the seal is a two-part seal.

Thus, the invention provides a seal whose first and second profiles can, when the seal is installed between two generally perpendicular surfaces, move relative to one another, to allow for movements between the two surfaces, whilst retaining the required watertight seal between the two surfaces.

BRIEF DESCRIPTION OF THE DRAWINGS

In order that the invention may be more fully understood, an embodiment of seal in accordance therewith will now be described by way of example and with reference to the accompanying drawings in which.

DETAILED DESCRIPTION OF ASPECTS OF THE INVENTION

Figure 1:
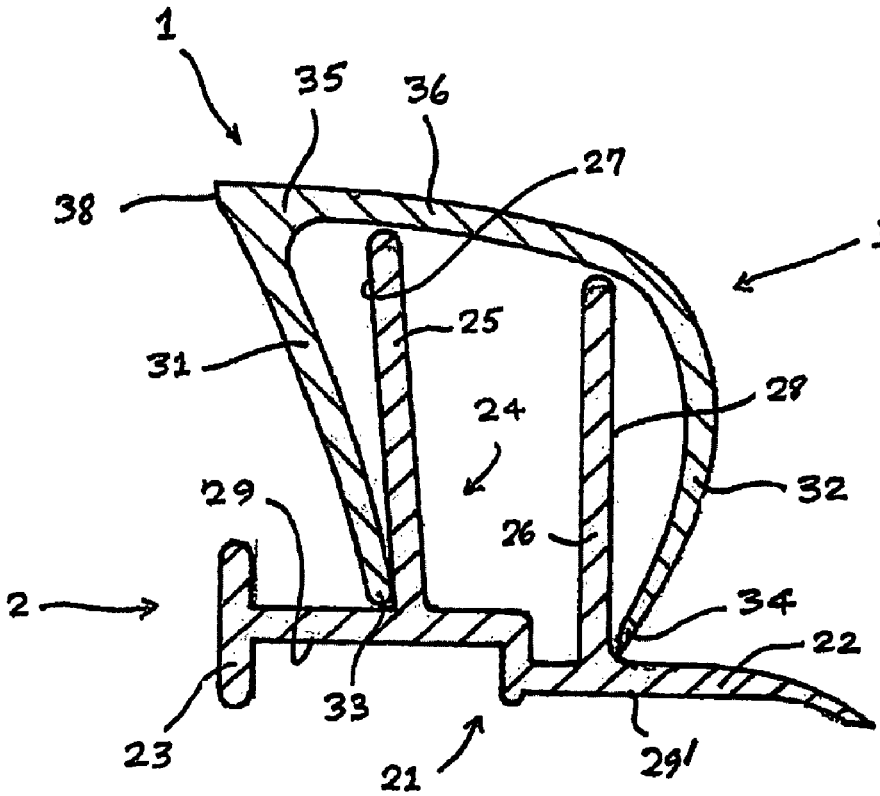
FIG. 1 is a sectional elevation of a seal in its contracted condition.
Figure 2:
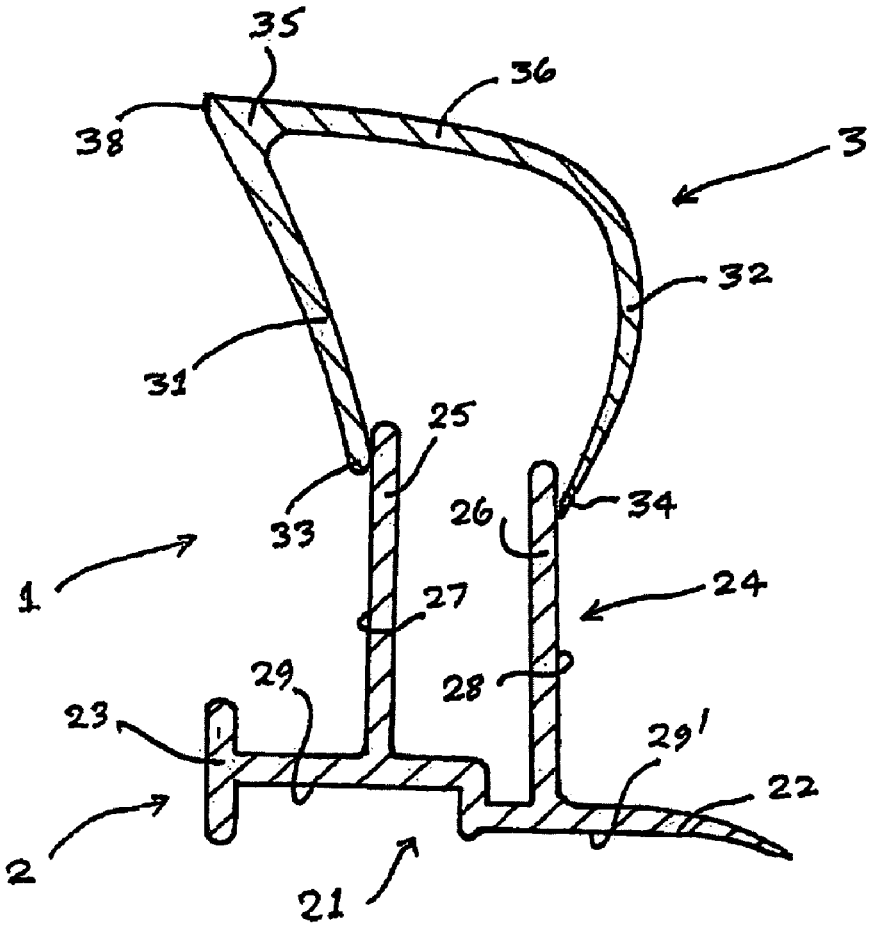
FIG. 2 is a sectional elevation of the seal shown in FIG. 1 but in its expanded condition.

Referring firstly to FIGS. 1 and 2 of the accompanying drawings, a two-part seal, indicated generally at 1, for sealing between the generally horizontal rim of a sanitary-wear item, such as a bath, and an adjacent wall comprises a first, lower profile 2 and a second, upper profile 3.

The lower profile 2 comprises a base 21 having respective outer toe and inner heal portions 22, 23, and an upstand, indicated generally at 24, comprising a pair of spaced inner and outer ribs 25, 26 upstanding from the base 21. Respective inner and outer surfaces 27 and 28 of the inner and outer ribs 25, 26 define respective inner and outer surfaces of the upstand 24.

The upper profile 3 comprises an inner, downwardly depending limb 31 and an outer downwardly depending limb 32 whose respective lower free ends 33, 34 engage the inner and outer surfaces 27, 28 of the upstanding ribs 25, 26 of the lower profile 2.

The lower free ends 33, 34 of the limbs 31, 32 engage slidably and bear resiliently against the respective inner and outer surfaces 27, 28 of the ribs 25, 26 and are connected together by a cover portion 36 whose juncture 35 with the upper end of the inner, downwardly depending limb 31 is adapted to engage at 38 a vertical wall, as will be described hereinafter.

The outer, downwardly depending limb 32 is arcuate, whilst the inner, downwardly depending limb 31 is generally linear, when viewed in cross-section, but, when the two profiles 2, 3 are assembled and installed, at least the outer limb 32 tends to bend to a certain extent, due to its resilient engagement with the outer surface of the upstanding rib 25.

Also, the inner, downwardly depending limb 31 is inclined inwardly of the seal 1, such that a space is defined between that limb 31 and the vertical wall with which the juncture 35 of the upper profile 3 engages and is secured adhesively thereto after installation. Upon installation, that limb 31 may also bend as it engages resiliently against the inner surface 27 of the inner rib 25.

Recesses 29, 29' are provided on the underside of the base 21 of the lower profile 2 adjacent respective inner heel and outer toe portions 22, 23 thereof. These recesses 29, 29' can accommodate adhesive for securing the lower profile 2 to the rim of a bath. Alternatively, the recess 29' may accommodate an adhesive tape for securing at least the outer toe portion 23 of the base 21 of the lower profile 2 to a bath rim, whilst adhesive applied to the bath rim and accommodated in the recess 29, cures.

Thus, FIGS. 1 and 2 illustrate the seal 1 in its respective contracted and expanded conditions, with conditions intermediate those extreme conditions resulting from movement between two generally perpendicular surfaces to which the profiles 2 and 3 are secured.

Figure 3:
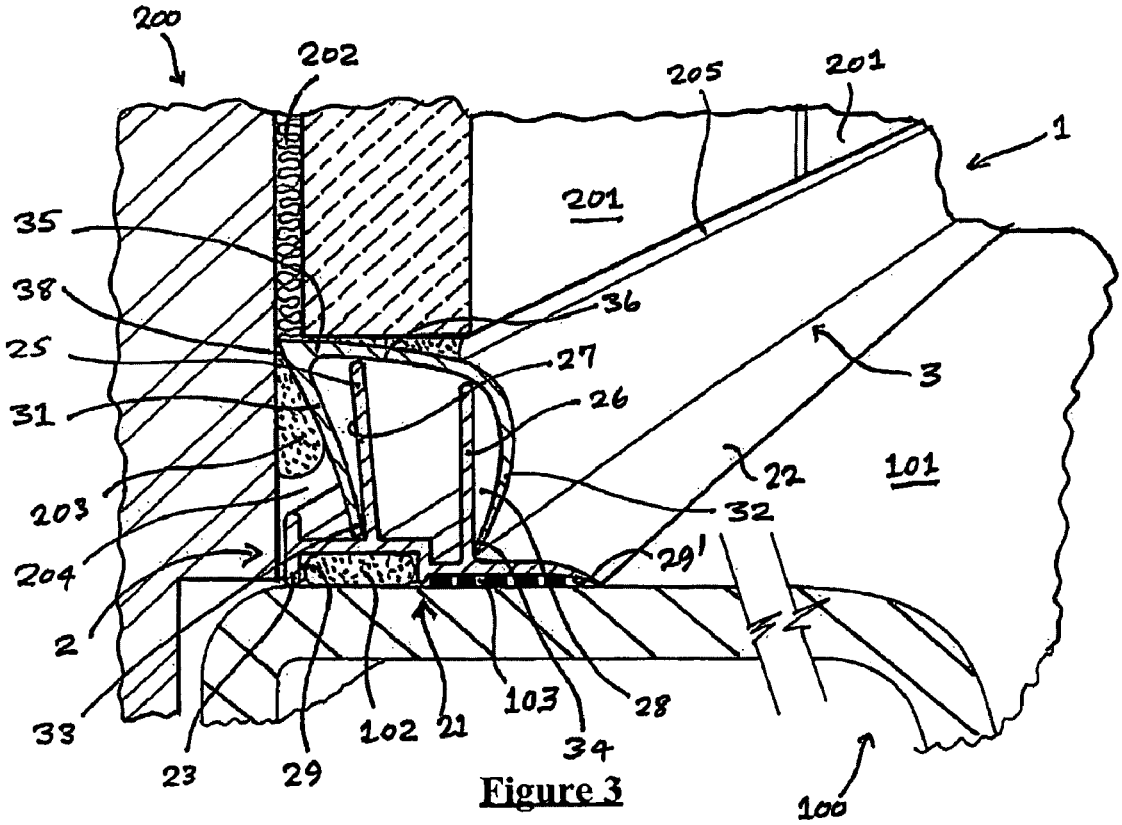
FIG. 3 is a perspective view, in partial section of the seal of FIGS. 1 and 2 installed between the rim of a bath and below tiling on a wall generally perpendicular thereto.

Referring now to FIG. 3 of the accompanying drawings, here is shown the seal 1 installed in a watertight manner between the generally horizontal rim 101 of a bath, indicated generally at 100, and an adjacent vertical wall, indicated generally at 200, with the seal 1 being located beneath a tile 201 secured by adhesive 202 to the surface of the wall 200.

In this particular arrangement, a bead of adhesive 102 has been applied to the bath rim 101 adjacent the wall 200 and the lower profile 2 of the seal 1 has been pressed on to the adhesive 102 which is accommodated within the recess 29.

A double-sided adhesive tape 103 pre-applied to and accommodated within the recess 29' was provided to hold the toe portion 22 of the base 21 of the lower profile 2 firmly against the bath rim 101, whilst the adhesive 102 located between the lower profile 2 and the edge of the bath rim 101, cured.

Then, a bead of adhesive 203 was applied to the wall 200 and the upper profile 3 of the seal 1 positioned with respect to the lower profile 2 by straddling that profile 2, with the inner and outer downwardly depending limbs 31, 32 resiliently engaging respective opposed, inner and outer surfaces 27,28 of the pair of upstanding ribs 25, 26 of the upstand 24 of the lower profile 2.

Because the inner downwardly depending limb 31 of the upper profile 3 is inclined inwardly of the seal 1, a space 204 is defined between that limb 31 and the surface of the wall 200 for accommodating the adhesive bead 203.

Subsequently, the upper profile 3 has been urged downwardly with respect to the lower profile 2, such that the disposition between the two profiles 2, 3 shown in FIG. 1 was assumed.

After that, tiles 201 were applied to the surface of the wall 200 by means of adhesive 202, to partially overlie the seal 1, after which sealing adhesive 205 was applied between the lower edge of the tiles 201 and the cover portion 36 of the upper profile 3 of the seal 1.

Because the lower free end 34 of the outer limb 32 engages the outer surface 28 of the outer upstanding rib 26 at a lower level than the lower free end 33 of the inner limb 31 engages the inner surface 27 of the inner upstanding rib 25 of the upstand 24, and also due to the resilient engagement of those lower free ends 34,33 of the respective outer and inner limbs 32,31 with the outer and inner surfaces 28,27 of the respective outer and inner upstanding ribs 26,25, an anticlockwise moment, when the seal installation is viewed in section, tends to be generated to urge the upper profile 3 of the seal 1 towards the adjacent wall 200, thereby tending to increase the integrity of the watertight seal between the bath rim 101 and wall 200. This has been found to be applicable for intermediate states of the seal 1 between its contracted and expanded conditions. Also, such a moment assists installation of the seal 1, in that at least the upper profile 3 tends to be urged against the wall 200 and retained in position whilst the other installation steps are completed.

In this manner, the seal 1 provides a watertight seal between the bath rim 101 and wall 200, which can accommodate not only vertical movement of the bath rim 101 with respect to the wall 200 and tile 201 but also a degree of longitudinal movement of the seal 1.

Figure 4:
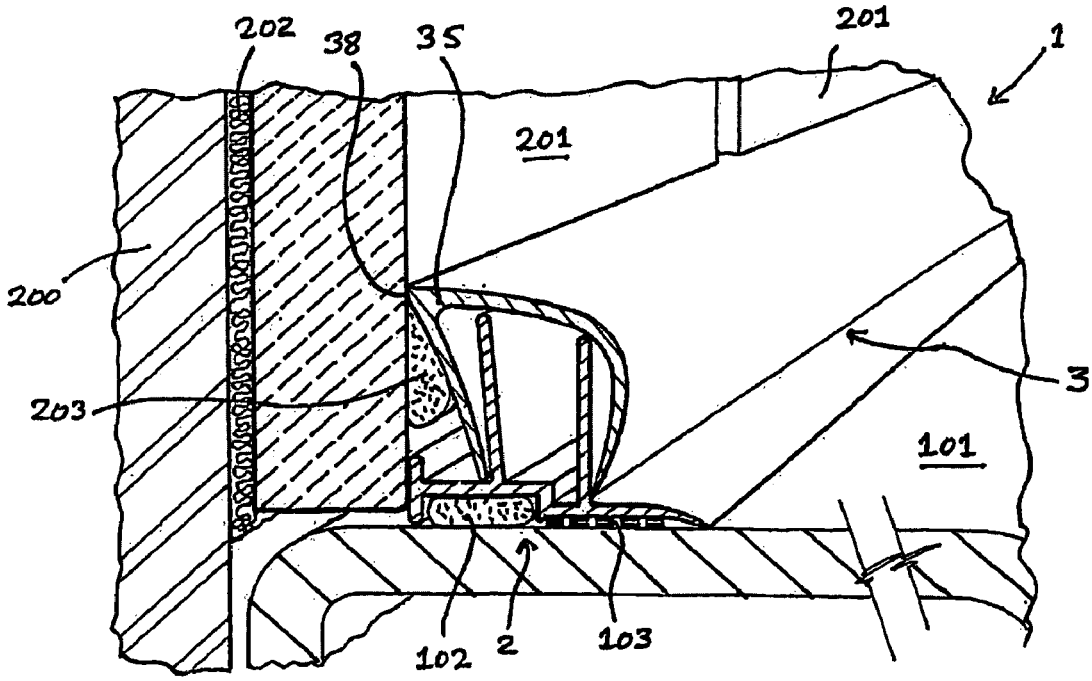
FIG. 4 is a perspective view, again in partial section, of the seal shown in FIGS. 1 and 2 installed between a bath rim and tiles secured to a wall perpendicular thereto.

Turning now to FIG. 4 of the accompanying drawings, here, the seal 1 has been applied between the bath rim 101 and a row of existing tiles 201.

The lower profile 2 of the seal 1 has been installed to the bath rim 101 in substantially the same manner as that described above in relation to FIG. 3, using the adhesive bead 102 and/or adhesive tape 103.

Adhesive 202 has then been applied to the wall tiles 201 and the juncture 35 of the upper profile 3 has been applied at 38 to the surface of the tiles 201 and moved downwardly with respect to the previously-applied adhesive 203, to wipe at least some of that adhesive 203 into the space 204 defined between the inner, downwardly depending limb 31 of the upper profile 3 and the surface of the tiles 201.

In a similar manner to the arrangement discussed above with reference to FIG. 3, the upper profile 3 straddles the upstanding ribs 25, 26 of the lower profile 2, in resilient and sliding engagement therewith.

Thus, once again, the seal 1 provides a watertight seal between the bath rim 101 and tiles 201, with any generally vertical movement between the bath rim 101 and the tiles 201 being accommodated by corresponding relative movement between the lower profile 2 and upper profile 3 of the seal 1.

Again, the seal 1 may also accommodate some relative horizontal movement between its lower and upper profiles 2, 3.

Figure 5:
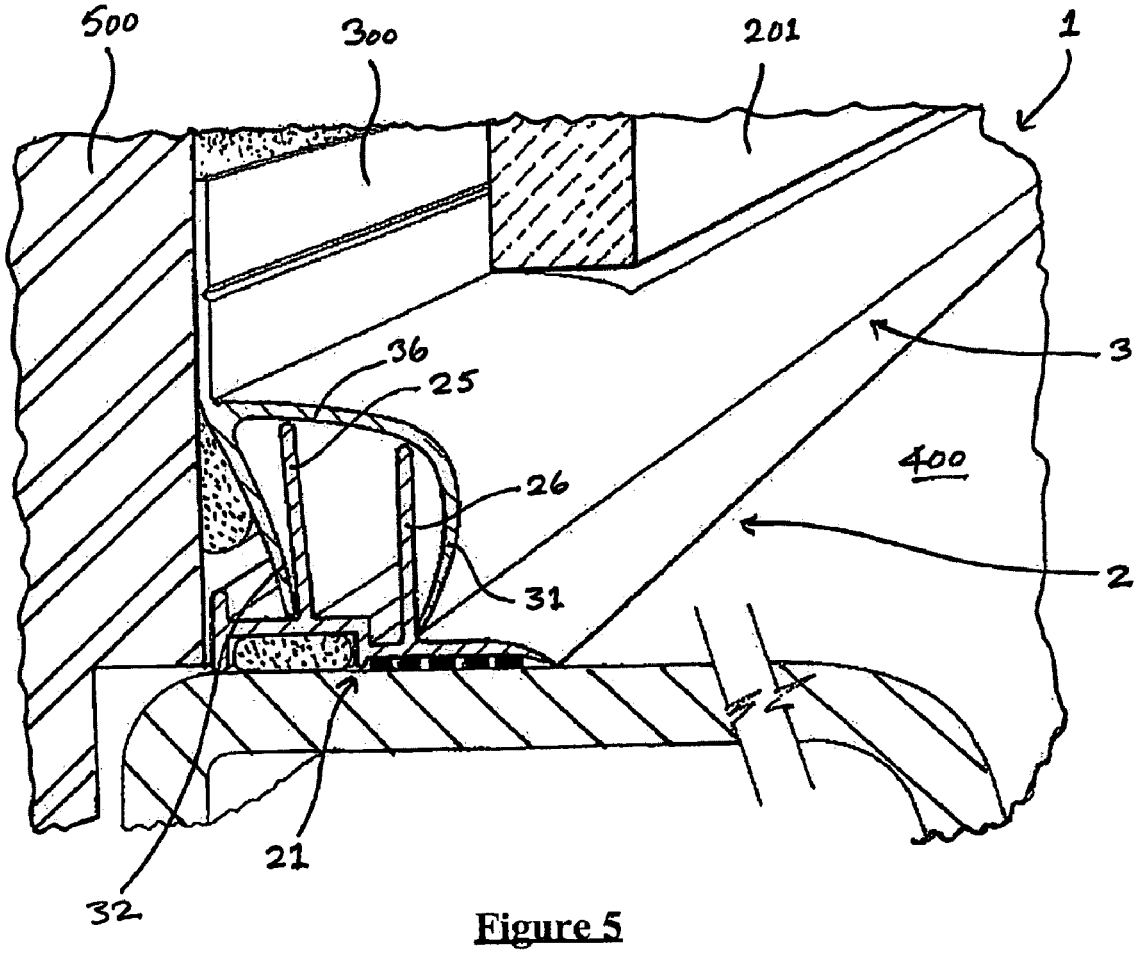
FIG. 5 is a perspective view, yet again in partial section, of the seal of FIGS. 1 and 2 installed between a working surface of a kitchen unit and an upstand secured to a wall perpendicular thereto.

In FIG. 5, a modified form of the seal 1 is shown in combination with a worksurface, bath or shower rim 400 and a wall 500 to which the worksurface, bath or shower rim 400 is installed. The seal 1 is substantially the same as those described above in relation to FIGS. 1 to 4, the components having been numbered correspondingly, but is provided with an integral upstand 300 which extends upwardly from the upper profile 3 and which is secured to the wall 500 by a mechanical and/or adhesive fixing (not shown).

Tiles or a showerboard 201 (only one tile shown) are secured to the wall 500 by adhesive (also not shown) but overlap the upstand 300. The mechanical and/or adhesive fixing secures the upstand 300 to the wall 500, with the tiles or showerboard 201 abutting the top of the upper profile 3, whereby those upstand fixings support the weight of the tiles or boards 201, rather than the seal 1 itself.

Figure 6:
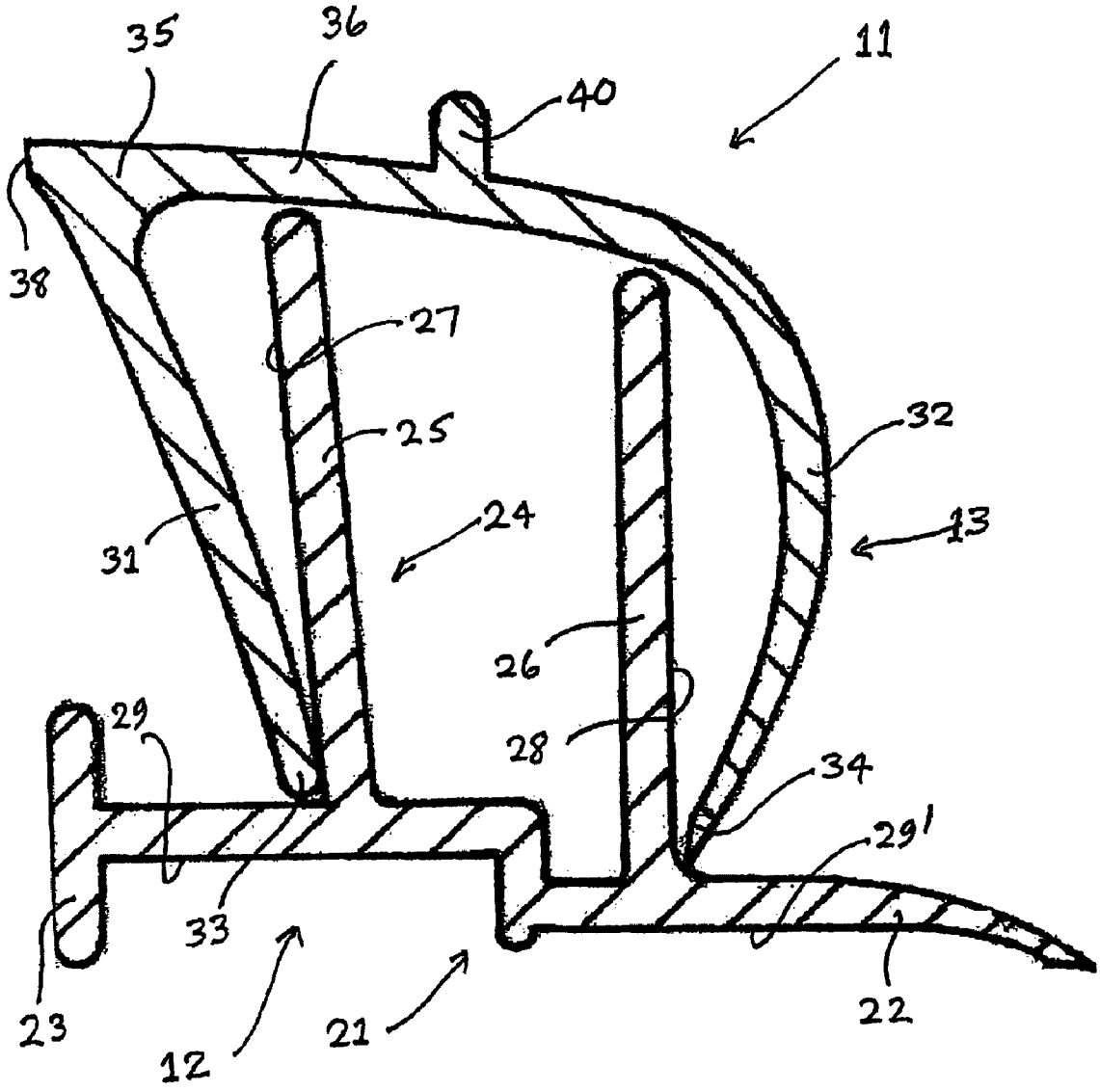
FIG. 6 is a sectional elevation of a modified form of seal in its contracted condition.

FIG. 6 shows another modified form of seal 11 which is substantially the same as the seals 1 described above in relation to FIGS. 1 to 5 and which comprises lower and upper profiles 12,13. The components of those profiles 12,13 are generally the same as those of the seal 1 and are numbered correspondingly.

However, the cover portion 36 of the upper profile 13 is provided with an upstanding rib 40 which, when the seal 11 is installed between the generally horizontal rim of a sanitaryware item, such as bath or shower tray, and an adjacent vertical wall, sealing adhesive (not shown) can be applied between the wall and rib 40 for sealing the lower edge of, say, a shower board to the cover portion 36 of the upper profile 13 of the seal 11.

Figure 7:
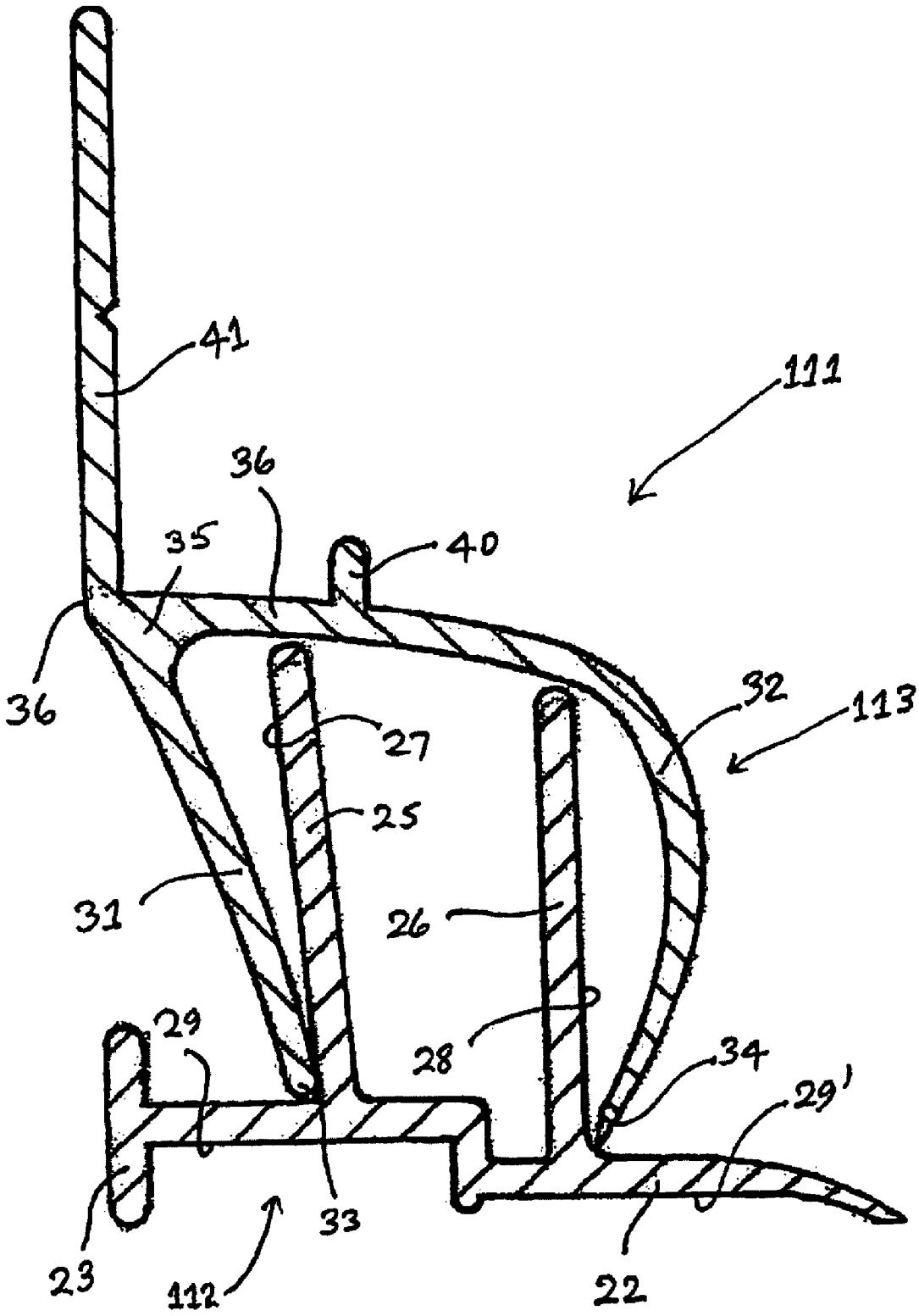
FIG. 7 is a sectional elevation of another modified form of seal, again in its contracted condition.

Yet another modified form of seal 111 is shown in FIG. 7, in which lower and upper profiles 112,113 are provided. In this case, the lower profile 112 is substantially identical to the lower profiles 2,12 of the seals 1, 11 described above in relation to respective FIGS. 1 to 5 and FIG. 6, with the upper profile 113 also including the rib 40 upstanding from the cover portion 36 of the upper profile 113. Again, the components of the seal 111 which are common with those of the seals 1,11, are numbered correspondingly.

However, in this modified form of seal 111, the upper profile 113 is provided adjacent the juncture 35 of its cover portion 36 and the upper end of its inner, downwardly depending limb 31, with a generally vertical upstand 41 which facilitates the securement of at least the upper profile 113 to an adjacent vertical wall or other support.

In this particular case, adhesive may be applied between the upstand 41 and rib 40 for sealing the bottom edge of, say, a shower board to the cover portion 36 of the upper profile 113 of the seal 111.

Figure 8:
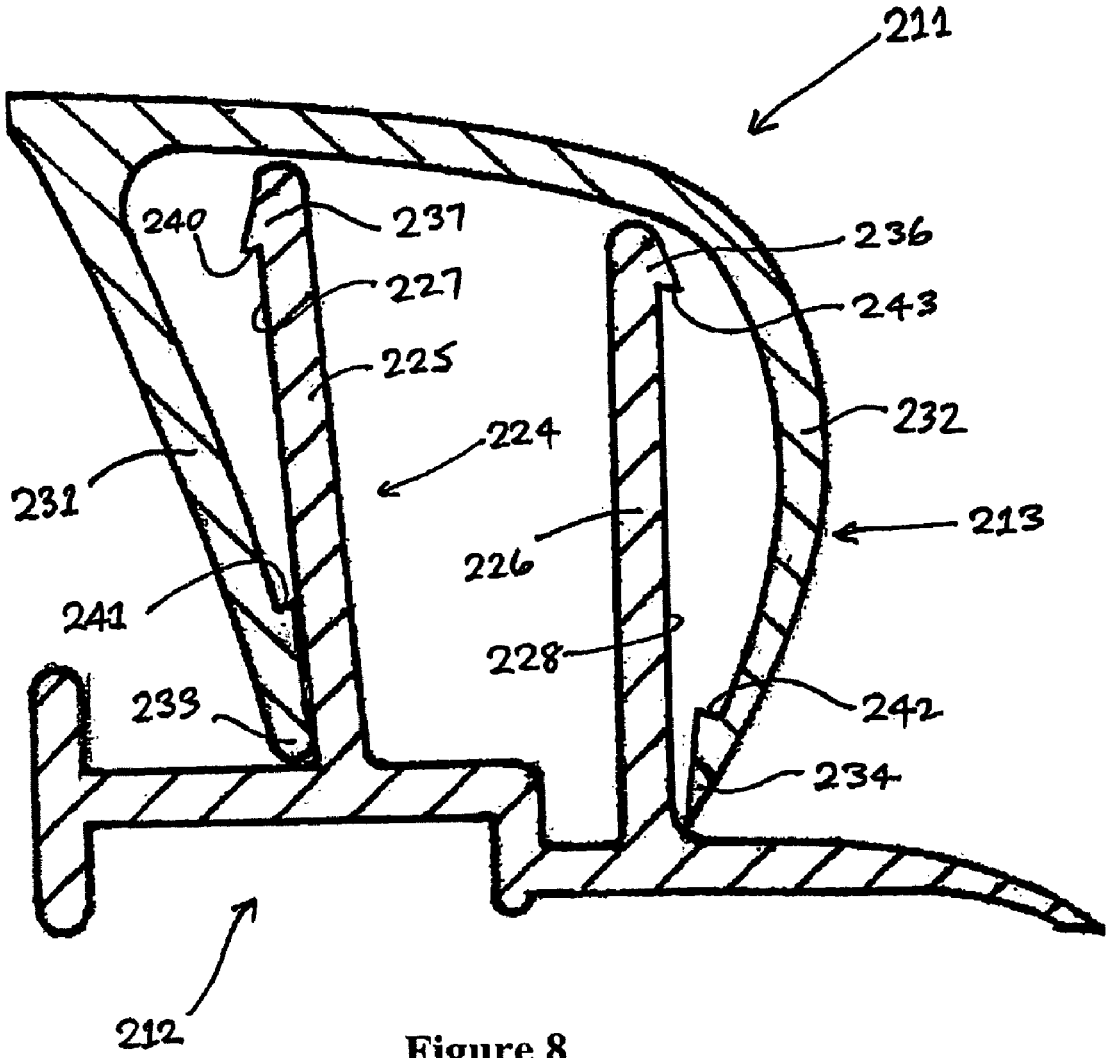
FIG. 8 is a sectional elevation of a further modified seal in its contracted condition.

In yet a further modified form of seal 211, as shown in FIG. 8, the lower and upper profiles 212,213 thereof are substantially similar to those of the seal 1 described above in relation to FIGS. 1 to 5.

However, in this particular form of seal 211, the upper ends 236,237 of the outer and inner ribs 225,226 which constitute the upstand 224 of the lower profile 212, are barbed at 240 and 243 at the respective inner and outer surfaces 227,228 thereof.

Similarly, the inner and outer downwardly depending limbs 231,232 of the upper profile 213 are barbed at 241,242, respectively, adjacent their lower ends 233,234.

In this manner, respective pairs of complementary and engageable barbs 240,241 and 243,242 are provided such that, when the seal 211 approaches its fully expanded condition, the barbs 240,243 on the ends 237,236 of the inner and outer ribs 225,226 of the lower profile 212 are engaged by the respective barbs 241,242 of the inner and outer limbs 231,232 of the upper profile 213, to prevent separation of those profiles 212,213.

It is to be noted that the inner upstanding rib 25,225 of the lower profiles 21,112,212 of the seals 1,11,111,211 described above in relation to FIGS. 1 to 8, are, in the fully contracted condition of the seal, inclined slightly out of the vertical away from the outer ribs 26,226. In the fully expanded conditions of the seals 1,11,111,211, those inner ribs 25,225 have been urged into the vertical or very close thereto, by the action of the respective inner depending limbs 31,231 of respective upper profiles 3,113,213.

Figure 9:
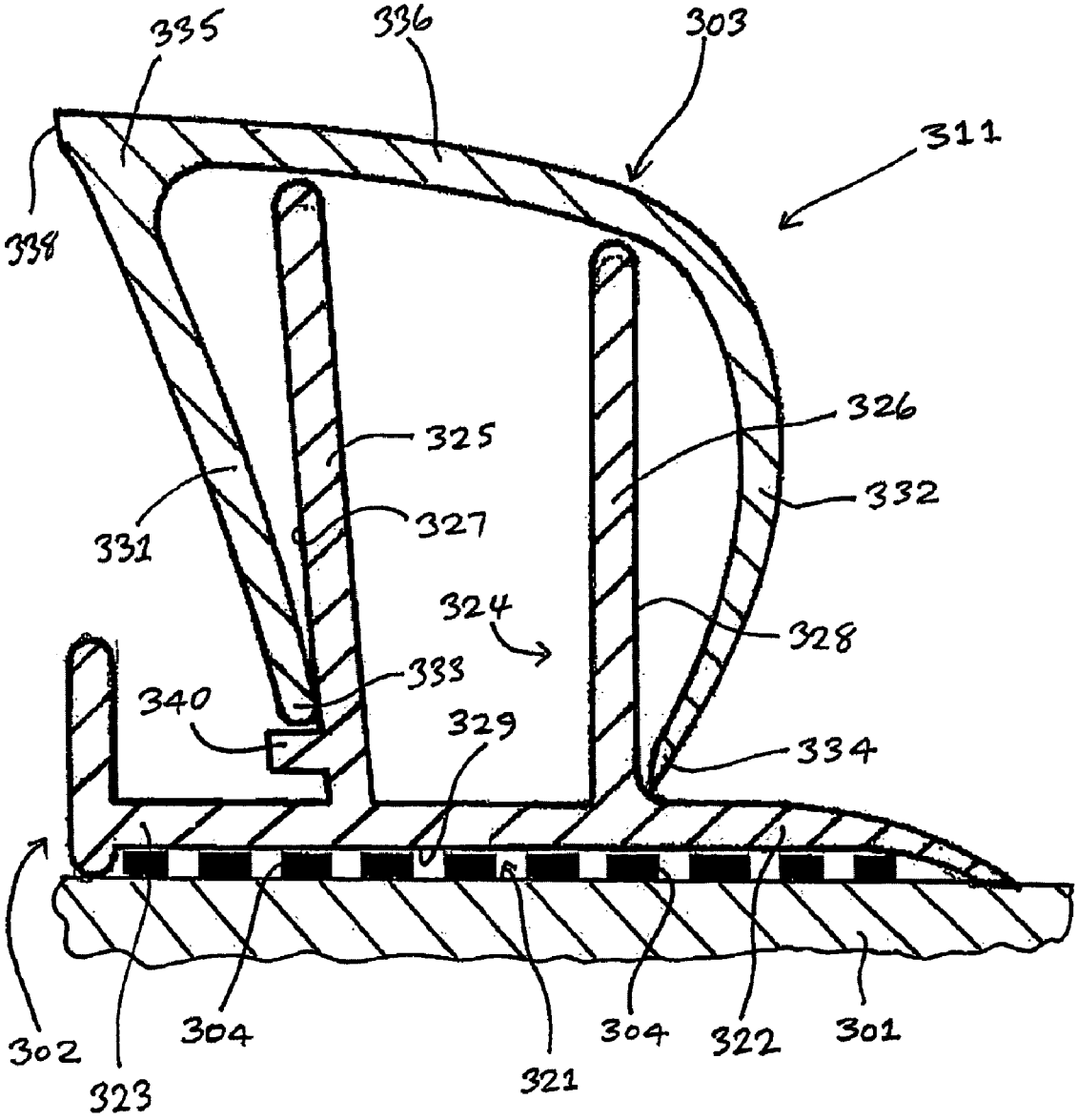
FIG. 9 is a sectional elevation of yet a further modified seal in its contracted condition.

Yet another further modified form of seal 311 is shown in FIG. 9. This seal 311 is similar to the seals 1,11,111 and 211 described above in relation to FIGS. 1 to 8, in that it comprises a lower profile 302 and an upper profile 303, with the lower profile 302 comprising a base 321 having respective outer toe and inner heal portions 322,323. Also provided is an upstand 324 comprising a pair of spaced inner and outer ribs 325,326 upstanding from the base 321. The upper profile 303 comprises an inner, downwardly depending limb 331 and an outer downwardly depending limb 332 whose respective lower free ends 333,334 engage the inner and outer surfaces 327,328 of the upstanding ribs 325,326 of the lower profile 302. These lower free ends 333,334 engage slidably and bear resiliently against the respective inner and outer surfaces 327,328 of the ribs 325,326 and are, again, connected together by a cover portion 336 whose juncture 335 with the upper end of the inner limb 331 is adapted to engage at 338 a vertical wall, as described hereinbefore.

However, in this modified seal 311, a stop 340 is provided at the lower end of the inner rib 325 and is engageable by the lower end 333 of the inner depending limb 331 of the upper profile 303, when the seal 311 is in its fully contracted condition as shown in FIG. 9.

Also, the base 321 of the lower profile 302 has on its underside a recess 329 which extends over substantially the whole of the width of the base 321 and which accommodates the thickness of a double-sided tape 304 adhered to the upper surface of the rim 301 of a sanitaryware item or the like and to the underside surface of the recess 329. In this manner, the lower profile 302 is secured and sealed to the rim 301.

Thus, it is to be appreciated that the invention provides a seal whose upper and lower profiles, when installed between a pair of generally perpendicular surfaces, are able to move with respect to each other when viewed in the section and, to a certain extent, longitudinally, whilst retaining the required watertight seal between the two surfaces.

It is to be appreciated also that other modifications may be made to the seal which fall within the scope of the following claims, without detracting from the integrity of the seal. For example, the upstand in the seals 1,11,111,211 and 311 described above have a pair of upstanding spaced ribs which constitute the upstand of the lower profile but may be replaced with a single rib or even more than two ribs. Further, the components of the seal may be made from any suitable material, preferably, a plastics material which can be extruded.

Further, it is to be understood that the embodiments of seal described above are two-part seals, which facilitate installation and reduce production costs.

The invention claimed is:

1. A two-part seal for sealing between two surfaces lying generally perpendicular to each other, the seal comprising:

a first profile which has a base adapted to be fixed sealingly to a first surface of the two surfaces and an upstand which projects from the base and which defines respective inner and outer opposed surfaces, wherein the upstand comprises two spaced upstanding ribs, one being an inner rib and the other being an outer rib; and a second profile which overlies the upstand of the first profile and which, when viewed in cross-section, comprises inner and outer depending limbs wherein an inner surface of the inner rib of the upstand is slidably engaged by the inner depending limb of the second profile and an outer surface of the outer rib of the upstand is slidably engaged by the outer depending limb of the second profile, wherein at least one of the inner and outer depending limbs of the second profile bears resiliently against a respective surface of the spaced upstanding ribs of the upstand of the first profile in sliding engagement therewith.

2. A seal according to claim 1, wherein both the inner and outer depending limbs of the second profile bear resiliently against the respective surfaces of the spaced upstanding ribs of the upstand of the first profile in sliding engagement therewith.

3. A seal according to claim 1, wherein the free end of one or each inner and outer depending limb of the second profile engages slidably the respective surface of the upstand of the first profile.

4. A seal according to claim 1, wherein the first profile represents a lower profile which can be secured to a generally horizontal surface and the second profile represents an upper profile securable to a wall or other generally vertical support surface, with the upstand of the lower profile projecting upwardly and the inner and outer limbs of the upper profile extending downwardly.

5. A seal according to claim 1, wherein at least the inner depending limb of the second profile is inclined inwardly of the seal.

6. A seal according to claim 1, wherein the inner and outer depending limbs of the second profile are resiliently bendable.

7. A seal according to claim 1, wherein the outer surface of the outer depending limb of the second profile and the outer surface of the upstand of the first profile define at least part of the outer surface of the seal when installed.

8. A seal according to claim 1, wherein the two spaced upstanding ribs are generally parallel with each other.

9. A seal according to claim 1, wherein, in a fully contracted condition of the seal, the two spaced upstanding ribs are inclined away from each other and, in a fully expanded condition of the seal, the two spaced upstanding ribs are generally parallel with each other.

10. A seal according to claim 1, wherein upper regions of the respective inner and outer depending limbs of the second profile are connected integrally together by means of a cover portion wherein a juncture of the cover portion with the upper region of the inner limb is adapted to engage sealingly one of the two surfaces.

11. A seal according to claim 10, wherein the second profile includes a rib upstanding therefrom, and the said rib upstands from the cover portion of the second profile.

12. A seal according to claim 10, wherein the base of the first profile has an inner heel and an outer toe adapted to be adhered sealingly to one of the two surfaces to which the seal can be installed, and wherein the second profile includes a rib upstanding therefrom, and the said rib upstands from the cover portion of the second profile.

13. A seal according to claim 10, wherein the inner and outer depending limbs of the second profile engage the respective inner and outer opposed surfaces of the upstand at different levels, and wherein the second profile includes a rib upstanding therefrom, and the said rib upstands from the cover portion of the second profile.

14. A seal according to claim 1, wherein the base of the first profile has an inner heel and an outer toe adapted to be adhered sealingly to one of the two surfaces to which the seal can be installed.

15. A seal according to claim 1, wherein the inner and outer depending limbs of the second profile engage the respective inner and outer surfaces of the upstand at different levels.

16. A seal according to claim 1, wherein the second profile includes a rib upstanding therefrom.

17. A seal according to claim 1, wherein at least one of the depending limbs of the second profile and the upstand of the first profile comprise complementary engageable barbs for preventing separation of the two profiles when the seal is in its fully expanded condition.

18. A seal according to claim 1, wherein the inner surface of the upstand includes a stop which is engaged by the free end of the inner limb of the second profile when the seal is in its fully contracted condition.

19. A seal according to claim 1, wherein the inner depending limb of the second profile is, when viewed in cross-section, generally linear.

20. A seal according to claim 1, wherein the outer depending limb of the second profile is, when viewed in cross-section, arcuate.

21. A seal according to claim 1, which is securable to one or both of the generally perpendicular surfaces by means of an adhesive, mastic, or double-sided adhesive tape.

22. An installation comprising a pair of generally perpendicular surfaces and a seal according to claim 1 secured between the surfaces in a watertight manner.

* * * * *